US006343421B1

(12) United States Patent
Levsen

(10) Patent No.: US 6,343,421 B1
(45) Date of Patent: Feb. 5, 2002

(54) BACTERIA RESISTANT WOODEN HANDLE KNIFE CONSTRUCTION

(75) Inventor: Clark A. Levsen, Shawnee, KS (US)

(73) Assignee: Hantover, Inc., Kansas City, MO (US)

( * ) Notice: Subject to any disclaimer, the term of this patent is extended or adjusted under 35 U.S.C. 154(b) by 0 days.

(21) Appl. No.: 09/266,082

(22) Filed: Mar. 10, 1999

(51) Int. Cl.[7] ..... B25G 3/00

(52) U.S. Cl. ..... 30/342; D8/107; D8/DIG. 4; 16/110.1

(58) Field of Search ..... 30/340, 342, 343, 30/345, 344, 337, 334; D8/7, 93, 107, DIG. 4; 16/110.1, 111.1, 430, 436; 174/46; 81/489, 492, 177.1

(56) References Cited

U.S. PATENT DOCUMENTS 412,479 A * 10/1889 Davis ..... 30/340
2,598,443 A * 5/1952 Roth ..... 30/340
3,201,869 A * 8/1965 Gambino ..... 30/342
4,565,004 A * 1/1986 Heinz ..... 30/343
5,155,913 A * 10/1992 Marttiini ..... 30/342
5,632,090 A * 5/1997 Smith ..... 30/340
5,724,739 A * 3/1998 Hutton ..... 30/340
5,920,991 A * 7/1999 Tracy ..... 30/342
6,070,329 A * 6/2000 Gibbs ..... 30/340
6,105,262 A * 8/2000 Rickard ..... 30/342

* cited by examiner

*Primary Examiner*—Kenneth E. Peterson
*Assistant Examiner*—Thomas J. Druan, Jr.
(74) *Attorney, Agent, or Firm*—Hovey, Williams, Timmons & Collins

(57) ABSTRACT

A cutting utensil is disclosed as including a wooden handle and a metal blade projecting outwardly from the handle. The handle includes a blade-receiving slot and an outer edge that circumscribes the slot and extends along the outer surface of the handle. The blade is partly received within the slot, and the outer edge of the handle is spaced from the blade to define a gap therebetween. The gap is filled with a synthetic resin material that bonds to the blade and handle. There consequently is no exposed metal-wood interface on the utensil, thereby eliminating the cracks and cavities normally associated with such an interface.

7 Claims, 1 Drawing Sheet

3.
3.
6.
6.
7.
7.
10
12
14
18
20
22
24
26
28
30
30a
30b
32
34
36
38
40

BACTERIA RESISTANT WOODEN HANDLE KNIFE CONSTRUCTION

BACKGROUND OF THE INVENTION

1. Field of the Invention

The present invention relates generally to utensils such as knives. More particularly, the present invention concerns a utensil having a wooden handle and an elongated, metal working element (e.g., a knife blade) projecting from the handle, with there being no exposed wood-metal interface on the utensil such that the utensil has none of the cavities and cracks normally associated with such an interface. That is to say, the present invention particularly concerns a wooden handle utensil design that significantly reduces the risk of microorganism growth on the utensil.

2. Discussion of Prior Art

Those ordinarily skilled in the art will appreciate that utensils having a wooden handle are desirable for numerous reasons. For example, users will often prefer a wooden handle because it is believed that wood is more attractive than other materials (e.g., metal or plastic). A utensil handle constructed of wood is also believed to improve comfort and secure gripping of the utensil, especially when the handle is wet. That is to say, the natural fibers of the wood will often cause the gripping surface to have a slightly roughened or textured quality. When the wood is wet, the fibers become even more aggressive and actually improve gripping of the wet handle. This is especially effective in industrial applications (e.g., use in a restaurant, grocery store, or meat processing plant), wherein the user is likely to handle the utensil in wet conditions. Moreover, industrial users will often wear a knit glove during handling of the knife, and the fibers of the wooden handle and the cloth fibers of the gloves will often create a hook-and-loop fastening effect that secures the utensil to the glove.

However, wooden handle utensils have heretofore been susceptible to microorganism contamination. That is to say, a conventional wooden handle utensil is typically incapable of being sufficiently cleaned of microorganisms by traditional washing techniques (e.g., soaking and/or scrubbing, placement in a standard household or industrial dishwasher, etc.). Those ordinarily skilled in the art will particularly appreciate that the wood-metal interface cooperatively defined by the wooden handle and the metal working element (e.g., knife blade) will present numerous cracks and/or cavities, even though the traditional interface is intentionally designed to be an abutting interengagement or joining of the blade and handle. It is noted that these spaces are in part attributable to the interstices defined within the wood. In any case, undesirable microorganisms are capable of proliferating within these small spaces, and it is difficult, if not impossible, to rid these spaces of such contamination. In this respect, wooden handle utensils are often banned from industrial use, thereby requiring workers to use the less preferred plastic handle utensils.

OBJECTS AND SUMMARY OF THE INVENTION

Responsive to these and other problems, an important object of the present invention is to provide a wooden handle utensil that is much less susceptible than conventional utensils, if not completely unsusceptible, to contamination by undesirable microorganisms. It is also an object of the present invention to provide a wooden handle utensil that can be used in virtually all industrial applications, without risking contamination of the food products as a result of microorganism growth on the utensil.

In accordance with these and other objects evident from the following description of the preferred embodiment, the present invention concerns a wooden handle utensil having a metal working element, such as a knife blade, projecting from the handle. The outer surface of the utensil has no exposed wood-metal interface along its outer surface, thereby virtually eliminating the risk of microorganism growth on the utensil. The preferred handle includes an element-receiving slot, in which the working element is partly received, and an outer edge circumscribing the slot and being spaced from the element. A synthetic resin filler is preferably set within the gap defined between the outer edge of the handle and the working element. Moreover, the filler bonds to the handle and working element so that none of the undesirable exposed cracks and/or cavities are presented on the utensil.

Other aspects and advantages of the present invention will be apparent from the following detailed description of the preferred embodiments and the accompanying drawing figures.

BRIEF DESCRIPTION OF THE DRAWING FIGURES

A preferred embodiment of the invention is described in detail below with reference to the attached drawing figures, wherein.

Figures 1, 2, 3, 4, 5, 6, 7:
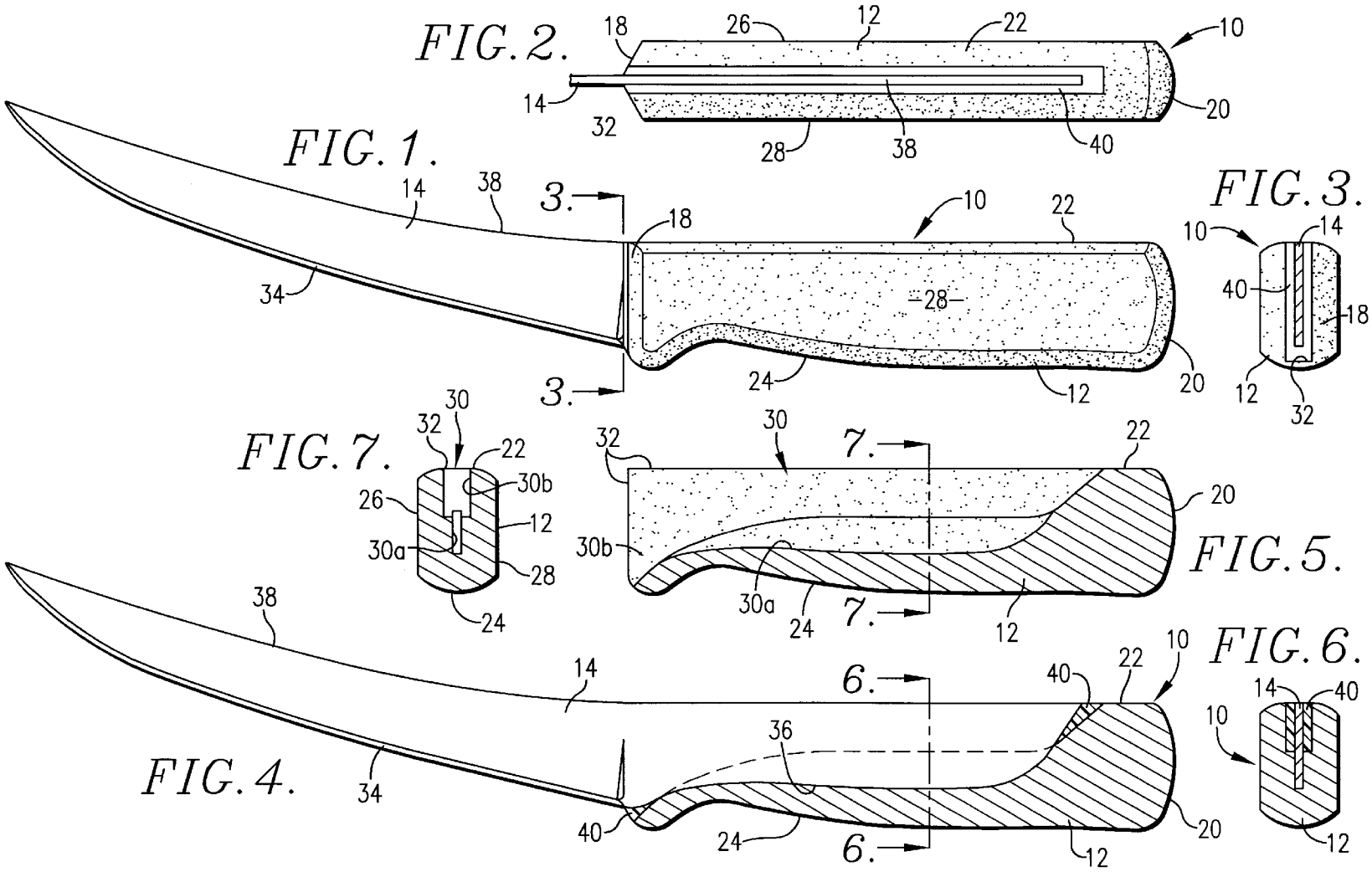
FIG. 1 is a side elevational view of a knife constructed in accordance with the principles of the present invention.
FIG. 2 is a fragmentary, top plan view of the knife, particularly illustrating the filler between the adjacent, exposed top portions of the handle and blade.
FIG. 3 is a cross-sectional view taken along line 3—3 of FIG. 1, particularly illustrating the filler between the adjacent, exposed end portions of the handle and blade.
FIG. 4 is a cross-sectional view of the knife taken along the side of the blade, particularly illustrating the blade being received within the slot defined in the handle.
FIG. 5 is a cross-sectional view of only the knife handle, with the blade being removed to illustrate the configuration of the blade-receiving slot defined in the knife.

FIG. 6 is a cross-sectional view of the knife taken along line 6—6 of FIG. 4, particularly illustrating the filler being set between the handle and blade in the outer portion of the blade-receiving slot and the blade being tightly received within the internal portion of the blade-receiving slot; and FIG. 7 is a cross-sectional view of the blade taken along line 7—7 of FIG. 5, particularly illustrating the outer and internal portions of the blade-receiving slot.

DETAILED DESCRIPTION OF THE PREFERRED EMBODIMENT

Turning initially to FIG. 1, the utensil 10 selected for illustration generally includes a wooden handle 12 and a working element 14 projecting from handle 12. The illustrated utensil 10 comprises a knife such that the working element 14 is in the form of a sharp blade. However, the principles of the present invention are equally applicable to various other types of utensils. For example, it is entirely within the ambit of the present invention to construct the wooden handle utensil as a spatula or sharpening rod such that the working element is flat plate or cylindrical bar, respectively.

With the foregoing caveat in mind, the handle 12 comprises a generally rectangular-shaped block of wood. Virtually any type of wood may be used to form the handle 12, although beechwood is preferred. The handle 12 has a first end face 18 (the left end face when viewing FIGS. 1–2 and 4–5) from which the blade 14 projects, with the end face 18 presenting obtuse sections on opposite sides of the blade 14 that cause the handle 12 to taper in the direction of the blade 14. On the other hand, the opposite end face 20 of the handle 12 presents a generally bulbous or rounded shape. Extending between the end faces 18 and 20 is a top face 22 (e.g., see FIG. 2), a bottom face 24 (e.g., see FIG. 7), and a pair of generally flat side faces 26 and 28 (e.g., see FIGS. 1, 2 and 7). As perhaps best shown in FIGS. 1 and 7, the top face 22 of the handle 12 is generally flat, except for the side chamfers defined along each of the side faces 26 and 28. To facilitate gripping of the handle 12, the bottom face 24 has a rounded cross-sectional shape (e.g., see FIG. 6) and a generally concavo-convex shape along its length (e.g., see FIGS. 1, 4 and 7). It will be appreciated that the faces 22,24,26,28 cooperatively define an outer surface of the handle 12.

A blade-receiving slot 30 is defined within the handle 12. In the illustrated embodiment, the blade-receiving slot 30 extends inwardly from the end face 18 and the top face 22, such that a continuous outer edge 32 extending along the end face 18 and top face 22 circumscribes the slot 30 (see FIGS. 2 and 5). However, the principles of the present invention are equally applicable to various other slot configurations (e.g., the blade-receiving slot may be deigned to extend inwardly only from one of the end faces such that the top face is solid). The illustrated slot 30 includes an internal portion 30*a* that is spaced inwardly from the outer edge 32 and a relatively larger outer portion 30*b* that extends between the internal portion 30*a* and edge 32. As shown in FIGS. 5 and 7, the internal and outer portions 30*a* and 30*b* of the slot 30 are each defined by a pair of parallel internal sidewalls that extend between the top face 22 and bottom face 24 of the handle 12, and a floor that is generally transverse to the sidewalls. It may be said that the outer portion 30*b* is somewhat of a counterbore that projects inwardly from the end face 18 and the top face 22. As will be described further below, the outer portion 30*b* is generally oversized relative to the portion of the blade 14 received therein, while the internal portion 30*a* is designed to tightly receive the blade 14 therein. In addition, the internal and outer portions 30*a* and 30*b* of the slot 30 are designed to conform generally to the shape of the blade 14.

The illustrated blade 14 is formed of a flat piece of metal, such as stainless steel. The blade presents a sharpened edge 34 that extends from the pointed end thereof to generally the end face 18 of the handle 12. Projecting along the bottom of the blade 14 beyond the edge 34 is a bottom surface 36 that has a shape that generally matches that of the floor defining the internal portion 30*a* of the slot 30 (compare FIGS. 4 and 5). A top surface 36 extends along the full length of the blade 14, with the portion of the top surface located inwardly of the end face 18 being flush with the top face 22 of the handle 12.

As previously indicated, the internal portion 30*b* of the slot 30 and the blade 14 are cooperatively designed so that the latter is snugly received within the former (see FIG. 6). This arrangement serves to, among other things, securely hold the blade 14 in the desired orientation during assembly of the utensil 10. However, the outer portion 30*b* is oversized so that a space is defined between the handle 12 and the blade 14. It will be appreciated that the outer portion 30*b* of the slot 30 can be variously configured (e.g., the outer portion may taper toward the internal portion), although it is critical that there be no exposed wood-metal interface defined by the handle 12 and blade 14. In the illustrated embodiment, the outer edge 32 is consequently spaced from the blade 14 to define a gap therebetween.

Moreover, the outer portion 30*b* of the slot 30 contains a filler 40 that serves to span the gap defined between the outer edge 32 and the blade 14. In this respect, the gap preferably has sufficient size to permit a suitable filler material to set therein. The gap size may vary depending upon the type of filler material used, although it has been determined that one suitable gap size is approximately ⅛ of an inch. In addition, the illustrated filler 40 sufficiently bonds to the handle 12 and blade 14 to prevent cracks or cavities from being defined between the filler 40 and the handle 12 or blade 14. It is also preferred that the bonding strength of the filler 40 is sufficient to securely interconnect the handle 12 and blade 14, although auxiliary attachment structure (e.g., adhesive within the internal portion 30*b* of the slot 30 or rivets connected between the handle 12 and blade 14) may be used. It has particularly been determined that a highly effective filler material is cold poured acrylic, although other materials such as other synthetic resins (e.g., epoxy resin) may be used. In any case, the preferred filler 40 spans completely between and bonds to the handle 12 and blade 14 along the outer portion 30*b* of the slot 30 (e.g., see FIGS. 2, 3 and 6).

In this respect, the exposed or outer surface of the knife 10 is devoid of the undesirable wood-metal interface normally associated with traditional wooden handle utensil designs. That is to say, the knife 10 does not have cracks and/or cavities in which microorganisms can become trapped, such that microorganisms are assuredly cleaned from the knife 10 using standard washing procedures.

It will be appreciated that the handle 12 has often been referred to herein as "wooden." However, this shall not mean that the handle 12 is required to be a solid wooden block having no other material or components forming a part thereof. But rather this term shall be interpreted to mean a handle construction that is at least in part formed of wood, particularly along the gripping surface of the handle. For example, the handle may include an internal metal reinforcing plate (not shown). In addition, the utensil may be provided with rivets (typically formed of metal) that facilitate attachment of the handle to the blade. Such an arrangement will likely require the rivets to be inset below the outer surface of the handle within a bore that is filled with a filler material similar to that in the outer portion 30*b* of the blade-receiving slot 30.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A utensil comprising:

an elongated wooden handle; and an elongated, metal working element fixed to the handle to project outwardly therefrom, said handle and working element cooperating to partly define an outer surface of the utensil, said outer surface being devoid of a wood-metal interface, said handle having an element-receiving slot along an elongate side of said handle, said handle having an outer edge extending along the outer surface and circumscribing the slot, said working element being partly received in the slot, with the outer edge of the handle and the element defining a gap therebetween; and a filler spanning the gap and being bonded to the handle and working element, said element-receiving slot including an internal portion spaced from the outer surface and configured to snugly receive the working element therein, and a relatively larger outer portion extending between the internal portion and the outer edge of the handle.

2. A utensil as claimed in claim 1, said working element comprising a knife blade.

3. A utensil as claimed in claim 2, said knife blade being formed of stainless steel.

4. A utensil as claimed in claim 1, said filler comprising a synthetic resin material.

5. A utensil as claimed in claim 4, said synthetic resin material being acrylic.

6. A utensil as claimed in claim 1, said handle presenting opposite end faces and a top face extending between the end faces, said element-receiving slot extending inwardly from one of the end faces and the top face.

7. A utensil as claimed in claim 6, said working element projecting outwardly from said one of the end faces and being generally flush with the top face.

* * * * *